US011267263B2

(12) United States Patent
Tok et al.

(10) Patent No.: US 11,267,263 B2
(45) Date of Patent: Mar. 8, 2022

(54) MOVEABLE PLATEN RIBS

(71) Applicant: Hewlett-Packard Development Company, L.P., Spring, TX (US)

(72) Inventors: Wee Hien Tok, Singapore (SG); Wesley Chia, Singapore (SG); Xu-Gang Wang, Shanghai (CN); Wei Lit Teoh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,719

(22) PCT Filed: Apr. 17, 2017

(86) PCT No.: PCT/CN2017/080815
§ 371 (c)(1),
(2) Date: Oct. 16, 2019

(87) PCT Pub. No.: WO2018/191850
PCT Pub. Date: Oct. 25, 2018

(65) Prior Publication Data
US 2020/0130384 A1 Apr. 30, 2020

(51) Int. Cl.
*B41J 11/06* (2006.01)

(52) U.S. Cl.
CPC ..... *B41J 11/06* (2013.01)

(58) Field of Classification Search
None
See application file for complete search history.

(56) References Cited

U.S. PATENT DOCUMENTS

| | | | | |
|---|---|---|---|---|
| 5,393,151 | A | 2/1995 | Martin et al. | |
| 5,940,092 | A | 8/1999 | Kashimura et al. | |
| 6,189,990 | B1 | 2/2001 | Youn | |
| 6,705,693 | B2 | 3/2004 | Lim et al. | |
| 7,625,148 | B2 | 12/2009 | Marra et al. | |
| 7,946,700 | B2 | 5/2011 | Rufes et al. | |
| 8,197,056 | B2 * | 6/2012 | Furukawa | B41J 2/155 347/104 |
| 8,888,272 | B2 * | 11/2014 | Hokazono | B41J 11/0085 347/104 |

(Continued)

FOREIGN PATENT DOCUMENTS

| | | | |
|---|---|---|---|
| CN | 1923524 | A | 3/2007 |
| CN | 101229727 | A | 7/2008 |

(Continued)

OTHER PUBLICATIONS

Printing and Cutting Components, 2007, 4 pages https://www.google.com/.

*Primary Examiner* — Alejandro Valencia
(74) *Attorney, Agent, or Firm* — HP Inc. Patent Department

(57) ABSTRACT

An apparatus (102) with moveable platen ribs (110,112), is described. The apparatus comprises a platen (108) for supporting print media (106). The platen extends in a plane in which the print media is conveyed to be printed. The apparatus further includes a first set of platen ribs (110) and a second set of platen ribs (112) each mounted on the platen. The second set of platen ribs are moveable approximately perpendicular to the plane.

15 Claims, 9 Drawing Sheets

(56) References Cited

U.S. PATENT DOCUMENTS

| | | | | |
|---|---|---|---|---|
| 8,950,847 | B2 * | 2/2015 | Seki | B41J 29/02 347/36 |
| 9,044,979 | B2 | 6/2015 | Somano | |
| 2007/0046757 | A1 | 3/2007 | Kim | |
| 2007/0176996 | A1 | 8/2007 | Yoshida et al. | |
| 2010/0026772 | A1 | 2/2010 | Miyata | |
| 2013/0135409 | A1 | 5/2013 | Ito et al. | |
| 2014/0015910 | A1 | 1/2014 | Tsang et al. | |

FOREIGN PATENT DOCUMENTS

| | | | |
|---|---|---|---|
| CN | 202412940 | U | 9/2012 |
| CN | 202895929 | U | 4/2013 |
| JP | 2011183745 | A | 9/2011 |
| TW | 201404608 | A | 2/2014 |

* cited by examiner

MOVEABLE PLATEN RIBS

BACKGROUND

Generally, printing operations in inkjet based print devices and apparatus involve moving a print media with respect to the print head. The print head ejects a predetermined volume of ink from its nozzle onto the print media to form characters, which form the printed content on the print media. During a printing operation, the print media is supported by a platen. Protrusions on the platen, referred to as platen ribs, maintain a separation distance between the print head and the print media. The separation distance is maintained to avoid placement errors of the ink droplets or to avoid smearing of the print media with the nozzles of the print head.

BRIEF DESCRIPTION OF THE DRAWINGS

The following detailed description references the drawings, wherein.

DETAILED DESCRIPTION

Figure 1:
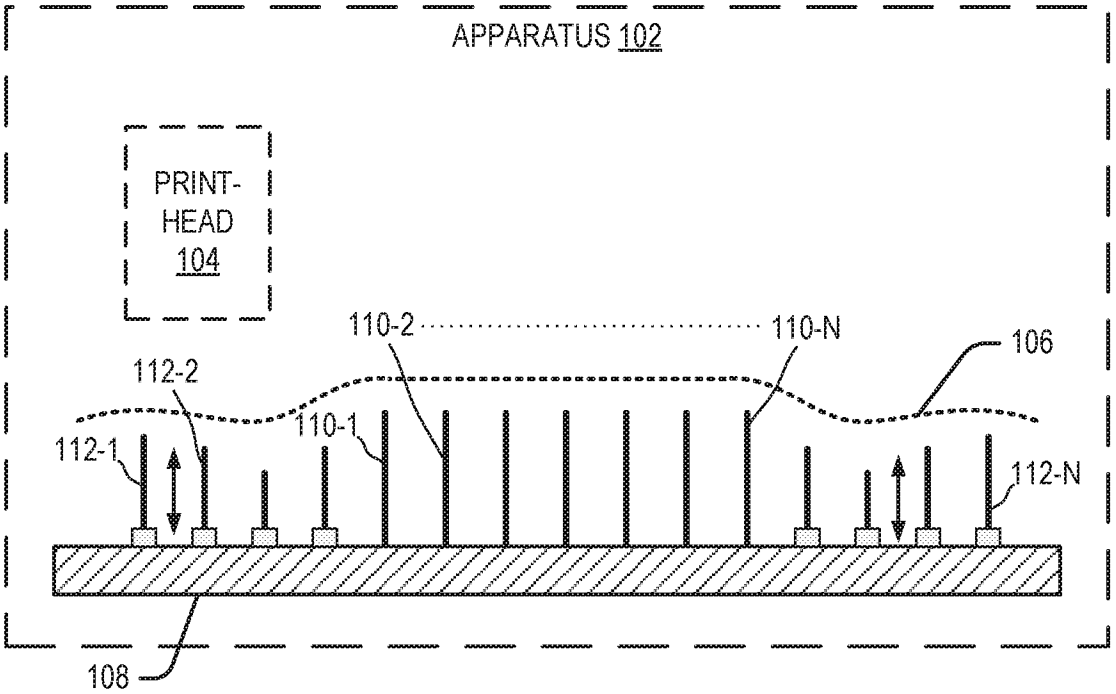
FIG. 1 is a diagram of an example apparatus including a platen having a set of moveable platen ribs.

Generally, printing operations in inkjet based apparatus involve moving a print media with respect to the print head. The print head ejects a predetermined volume of ink from its nozzles onto the print media to form characters, forming printed content on the print media. A separation distance between the print head and the print media is maintained for desirable print quality. For example, the separation distance may be close enough to prevent drop placement errors of the ink droplets. At the same time, a minimum separation distance may be maintained to avoid the print media smearing against the nozzle of the print head. If the distance is less than such a minimum distance, the print media may contact with the nozzles of print head resulting in obstructions in the print path causing jams.

It is also observed that the print media may undergo certain physical changes once ink is deposited. For example, the print media may curl or get bent at its edges upon ink deposition, or may experience cockling. On curling or cockling, the separation distance between the print media and the print head decreases which may result in smearing or the print media getting jammed. Cockling may be understood as planar alteration appearing as creases on the surface of the print media. Such variations, in the otherwise regular surface of the print media, may decrease the separation distance between the print head and the print media during printing.

The print media is supported by a series of platen ribs during the printing operation. Generally, each of such platen ribs may be formed as plates and are rigidly mounted on a platen. The platen ribs are positioned such that the plane in which the platen ribs lie is approximately perpendicular to the surface of the print media. The surface of the print media maintains contact with the edges of the platen ribs as the print media is conveyed during printing. The platen ribs may be arranged in a series, with adjacent platen ribs spaced by specific distances. Generally, the height of the platen ribs varies. For example, certain platen ribs which are to contact the portions of the print media which lie about the edges, may be shorter as compared to other platen ribs as they extend from the surface of the platen. The shorter platen ribs are to counter any curling which may occur at the edges of the print media. In such cases owing to the shorter ribs, the distance between the print head and the print media is maintained even though the print media may have curled towards the print head.

It is possible that the print media may not always curl during the printing process. In such cases, the sunken ribs may result in an increase in the separation distance between the print head and the print media. Such an increase in the separation distance may decrease print quality at the edges of the print media. Examples include variations in contrast, increase in graininess, and fuzziness in the printed content near the edges of the print media.

An apparatus with a set of moveable platen ribs is described. The present description also describes approaches for controlling separation distance between a print media and a print head of such an apparatus, through the set of moveable platen ribs. In one example, the apparatus may include a platen mounted with a first set and a second set of platen ribs. The first set of platen ribs may be positioned such that they support a central portion of the print media. The first set of platen ribs are rigidly mounted on the platen. The second set of platen ribs are so positioned such that they correspond to portions lying in proximity to the edges or corners of the print media. The platen ribs may be formed as plates which extend approximately perpendicular from the surface of the platen.

The second set of platen ribs are moveable in a plane in which they are located. Each of the second set of platen ribs may move between one or more positions, between a completely raised and a completely lowered position. In one example, the edges of the second set of platen ribs when fully extended in the raised position, align with the edges of the rigidly fixed first set of platen ribs. In a lowered position, the height of the second set of platen ribs is less relative to the height of the first set of the platen ribs with respect to the platen. The second set of platen ribs control the separation distance between the print media and the print head of the apparatus. In one example, each of the second set of platen ribs may be either independently moveable or may move collectively, without deviating from the scope of the present subject matter. In another example, the second set of platen ribs may even be grouped into segments. Each segment of platen ribs may move independently or in unison with respect to each other.

In operation, values of print-related parameters for a printing operation may be obtained. The print-related parameters may include attributes corresponding to an executed print job or physical properties of the print media. Examples of attributes pertaining to the print job may include, but not limited to, an ink density; physical properties of the print media such as size; weight, and stiffness. The print-related parameters may be considered as conditions which when present during the printing operation, are likely to result in physical effects, such as curling, of the print media. It should be noted that physical effects refer to changes in the physical attribute of the print media which would result in variations between the otherwise regular surface of the print media. Other examples of print-related parameters may also be relied on without deviating from the scope of the claimed subject matter.

Returning to the operation of the apparatus, once the values of print-related parameters are obtained, the likelihood of occurrence of any physical effects of the print media are estimated. In one example, the estimation may be based on values of the print-related parameters. For corresponding values of print-related parameters, it may be concluded that physical effects of the print media may occur. Based on such estimation, one or more control instructions may be generated. Such control instructions when executed may further actuate an actuation mechanism for raising or lowering the second set of platen ribs. In one example, if it is determined that the print media is likely to curl, the control engine may enable lowering of the set of platen ribs. On the other hand, if it is determined that the print media is not likely to curl, the set of platen ribs may be raised to maintain the specific separation distance between the print media and the print head. An example of such an actuation mechanism includes, but is not limited to, a cam and linkage system.

As would be understood, the present subject matter enables controlling the spacing between the print media and the print head by assessing whether the print media is likely to curl. Accordingly, a set of platen ribs may be raised or lowered thereby preventing the print related artifacts and improving the overall print quality of the print output. In another example, the dimensions of the second set of platen ribs may also be unequal. In such examples, the relative variation between the each of the second set of platen ribs may occur owing to the different size of each of the platen ribs, when lowered. The present approaches are further implemented using less complex mechanisms as are generally known.

These and other aspects are described in conjunction with various examples as illustrated in FIGS. 1-8. The present description is provided for print devices which may have a print carriage assembly. However, the scope of the present subject matter may not be limited to such print devices. Other types of devices may also be included within the scope of the present subject matter without any limitation. Furthermore, in some figures, various components for which no protection is sought have been illustrated using dotted lines.

FIG. 1 illustrates an apparatus 102 for controlling spacing between print media and print head. The apparatus 102 may be implemented as print devices. Print devices may include printers or other multifunction devices which may which perform other functions, such as a scanning, in addition to printing. In the present example, the apparatus 102 may include a print head 104. The print head 104 may include one or more nozzles through which a predefined volume of ink is ejected and deposited on the print media 106, to form the printed content. During the printing operation, the print media 106 is supported on platen 108. The platen 108 may further be provided with a first set of platen ribs 110-1, 2, . . . , N (referred to as platen ribs 110) and a second set of platen ribs 112-1, 2, . . . , N (referred to as platen ribs 112). The platen ribs 110 may be formed as plates which extend from the surface of the platen 108 in an approximately perpendicular direction. During the printing operation, the print media 106 is supported by the platen ribs 110 and 112 as the print media 106 is conveyed through the print path in the apparatus 102.

Of the platen ribs 110 and 112, the first set of platen ribs 110 are rigidly mounted on the platen 108. The second set of platen ribs 112 also extend approximately perpendicular from the surface and are moveable with respect to the platen 108 (as is indicated in FIG. 1). In one example, each of the second set of platen ribs 112 may move between a raised and a lowered position. In the raised position, the height of the second set of platen ribs 112 is comparable and approximately equal to the height of the first set of platen ribs 110. Correspondingly, in a lowered position the height of the second set of platen ribs 112 is less than the height of the first set of platen ribs 110.

The second set of platen ribs 112 are so positioned such that they support the corners or edges of the print media 106. During the printing operation, the second set of platen ribs 112 may be moved between a raised and lowered position depending on whether the print media 106 undergoes any physical changes which may decrease an overall separation distance between the print head 104 and the print media 106. If it is determined that the print media 106 is not likely to undergo any physical changes, the second set of platen ribs 112 may be fully extended in the raised position such that the furthermost edges of the second set of platen ribs 112 are aligned with the edges of the first set of platen ribs 110. Thus, the separation distance between the print head 104 and the print media 106 is maintained. On other hand, if it is determined that the print media 106 is likely to undergo any physical change, one or more of the second set of platen ribs 112 may be lowered. For example, it may be the case that the print media 106 is likely to curl up towards the print head 104 thereby decreasing the separation distance. In such a case, one or more of the second set of platen ribs 112 may be lowered such that the separation distance between the print head 104 and the print media 106 is maintained. The second set of platen ribs 112 may be controlled either individually or collectively. In one example, the print-related parameters may be utilized for determining whether any physical changes to the print media 106 are likely to occur during the printing operation. Accordingly, the second set of platen ribs 112 may be raised or lowered depending on values of the print-related parameters.

Apparatus and approaches as described allow raising and lowering the second set of platen ribs 112 to control spacing between print media and print head. Furthermore, the second set of platen ribs 112 may be raised or lowered depending on print-related parameters which in turn indicate whether the print media 106 is likely to undergo any physical changes. Such physical changes, as explained previously, result in a change in the separation distance between the print head 104 and the print media 106. As per one example, the likelihood of physical changes may be preempted, and accordingly the ribs lowered thereby ensuring that the separation distance is within a prescribed range. This in turn reduces fuzziness and graininess of the image, thereby improving print quality.

Figure 2:
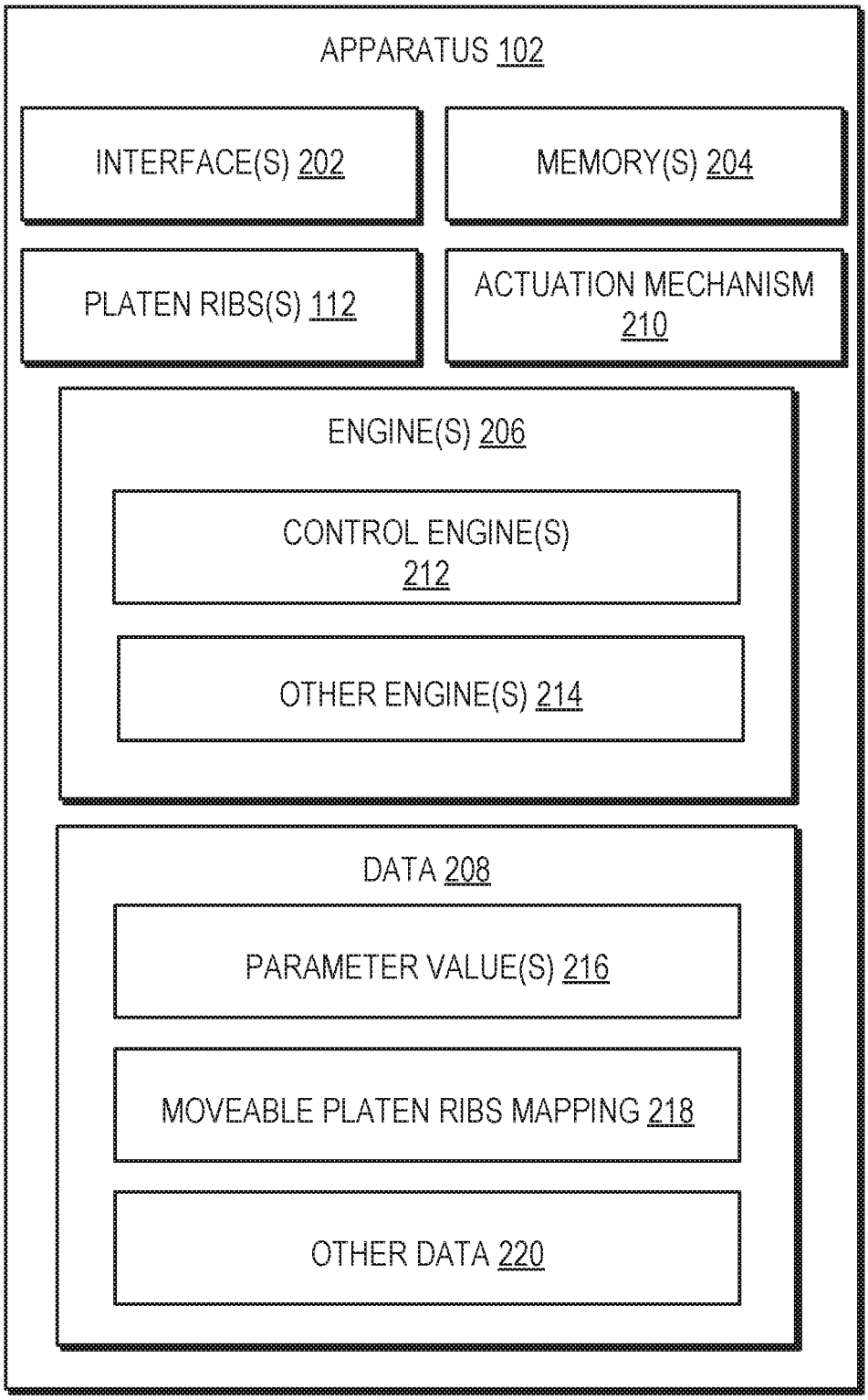
FIG. 2 is a diagram of another example apparatus having a set of moveable platen ribs for controlling spacing between print media and print head.

These and other examples are provided in further detail in conjunction with the remaining figures. FIG. 2 illustrates the apparatus 102 which, in one example, may be implemented as a print device. The apparatus 102 as illustrated in FIG. 2 may be implemented using programmable logic, either by way of hardware or software. In the present example, the apparatus 102 includes an interface(s) 202, memory(s) 204 and second set of platen ribs 112 (referred to as platen ribs 112). The interface(s) 202 may include a variety of interfaces, for example, interfaces for data input and output devices, referred to as I/O devices, storage devices, network devices, and the like. The interface(s) 202 facilitate communication between the apparatus 102 and other computing devices connected in a networked environment. In one example, the interface(s) 202 may provide an interface for communication between the apparatus 102 and the display unit 202. The memory 204 may store one or more computer-readable instructions, which may be fetched and executed, resulting in generating an alert to enable a user to retrieve a printed document. The memory 204 may include any non-transitory computer-readable medium including, for example, volatile memory such as RAM, or non-volatile memory such as EPROM, flash memory, and the like. The apparatus 102 further includes engine(s) 206 and data 208.

The apparatus 102 further includes an actuation mechanism 210. The actuation mechanism 210 may be in communication with the any one of the engine(s) 206. The actuation mechanism 210 is also mechanically coupled to each of the second set of platen ribs 112. The engine(s) 206 during the operation of the apparatus 102 may generate control signals for operating the actuation mechanism 210. On receiving the control signals, the actuation mechanism 210 may enable moving of the platen ribs 112 between a raised and lowered position.

The engine(s) 206 may be implemented as a combination of hardware and programming (for example, programmable instructions) to implement one or more functionalities of the engine(s) 206. In examples described herein, such combinations of hardware and programming may be implemented in a number of different ways. For example, the programming for the engine(s) 206 may be processor executable instructions stored on a non-transitory machine-readable storage medium and the hardware for the engine(s) 206 may include a processing resource (for example, one or more processors), to execute such instructions. In the present examples, the machine-readable storage medium may store instructions that, when executed by the processing resource, implement engine(s) 206. In such examples, the apparatus 102 may include the machine-readable storage medium storing the instructions and the processing resource to execute the instructions, or the machine-readable storage medium may be separate but accessible to apparatus 102 and the processing resource. In other examples, engine(s) 206 may be implemented by electronic circuitry.

The data 208 includes data that is either predefined or generated as a result of the functionalities implemented by any of the engine(s) 206. In an example, the engine(s) 206 include the control engine(s) 212, and other engine(s) 214. The other engine(s) 214 may implement functionalities that supplement applications or functions performed by the apparatus 102. Further, the data 208 may include values of print-related parameters (referred to as parameter values 216), mapping data 218 and other data 220.

As mentioned previously, the second set of platen ribs 112 are moveable with respect to a platen 108. The platen ribs 112 may move in a direction which is approximately orthogonal to the plane in which the platen 108 is present. The platen ribs 112 may be either in a raised position or a lowered position. For example, the platen ribs 112 may be in a lowered position if the print media 106 is likely to undergo curling or any other physical changes. Similarly, if it is determined that the print media 106 is not likely to undergo any changes, then the platen ribs 112 may be in a raised position. While the platen ribs 112 is in a lowered position, the relative height of the platen ribs 112 is less than the height of the first set of platen ribs 110 (shown in FIG. 1). Conversely, while in the raised position, the height of the platen ribs 112 is comparable or equal to the height of the first set of platen ribs 110.

In one example, the control engine(s) 212 may control the movement of the platen ribs 112. To this end, the control engine(s) 212 may determine one or more values of print-related parameters (i.e., parameter values 216) for a print job. A print job may be considered as any printing operation that may have to be executed or performed by the apparatus 102 in response to a print command from a user. The print job may generally define the content which is to be printed, say, on the print media 106. The instructions from the user may be processed by a computing device (not shown in FIG. 2). Such a computing device may then transmit such instructions to the apparatus 102. Based on the instructions; the apparatus 102 determines the manner in which the content is to be rendered, i.e., printed, onto the print media.

The print-related parameters may be considered as defining one or more parameters based on which a print device, such as the apparatus 102, processes instructions and prints content on a print media 106. For example, if the content involves areas having darker tones, the corresponding print-related parameters may prescribe certain values based on which the apparatus 102 determines which type of ink or volume of ink that needs to be ejected from the print head 104. The print-related parameters may also prescribe the type of print media 106 that may have to be used for printing a desired content. For example, it is possible that content may have to be printed on a print media 106 which is stiffer or perhaps even larger in size. The parameter values 216 may provide one or more values depicting such different conditions which may be present or have to be considered while processing a print job.

Continuing with the present example, the apparatus 102 may receive a print command indicative of a print job. The control engine(s) 212 may obtain the values of the print-related parameters from the print command. The control engine(s) 212 may store the values as parameter values 216. The control engine(s) 212, based on the parameter values 216, may estimate whether the print media 106 is likely to undergo any physical changes (such as curling) during the printing operation. In one example, the control engine(s) 212 may compare the parameter values 216 with the mapping data 218. The mapping data 218 may provide a mapping between one or more parameter values 216 with indications suggesting that the print media 106 is likely to undergo a change. For example, parameter values 216 indicating a high ink density may be considered as possible conditions for occurrence of curling in the print media 106. Similarly, a parameter values 216 indicating that a stiffer print media 106 is being utilized may be indicated as a condition which will not result in any physical changes in the print media 106. It should be noted that the examples relied are only indicative and not limiting. Other examples of parameter values 216 and corresponding conditions may also be used, without deviating from the scope of the claimed subject matter. In another example, the parameter values 216 may be either user prescribed or may be based on historical or other analytical data.

Figure 3:
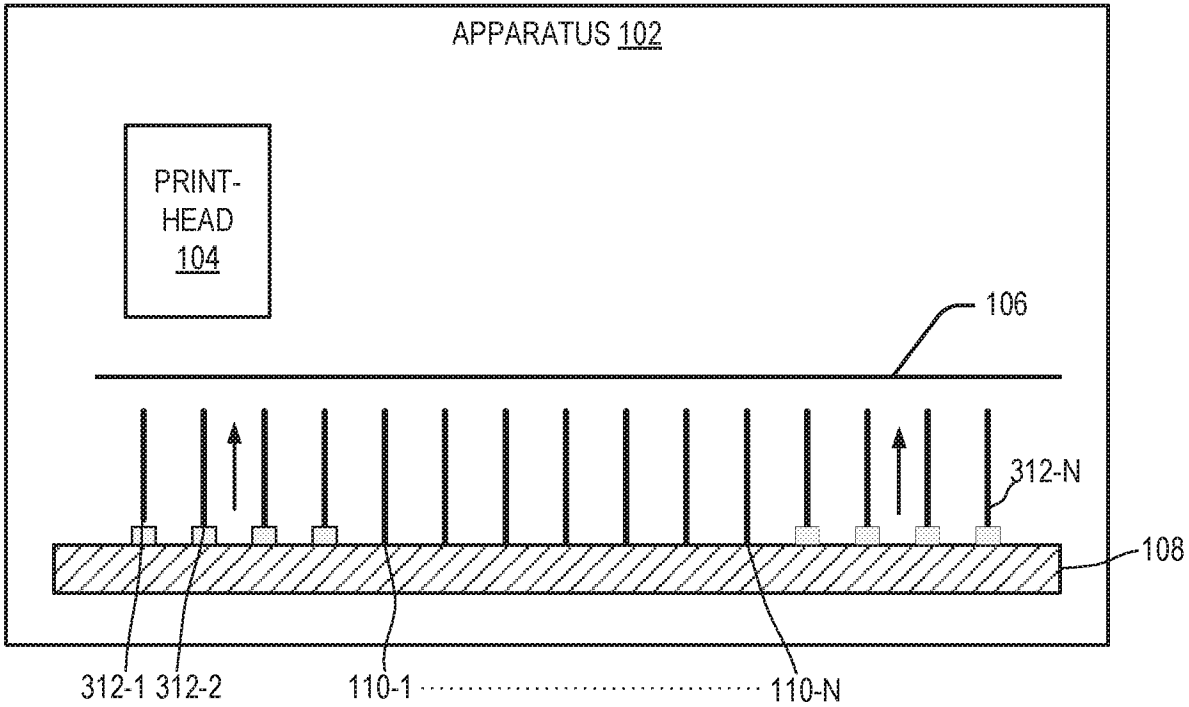
FIG. 3 depicts a front view of an example platen with raised set of platen ribs.
Figure 4:
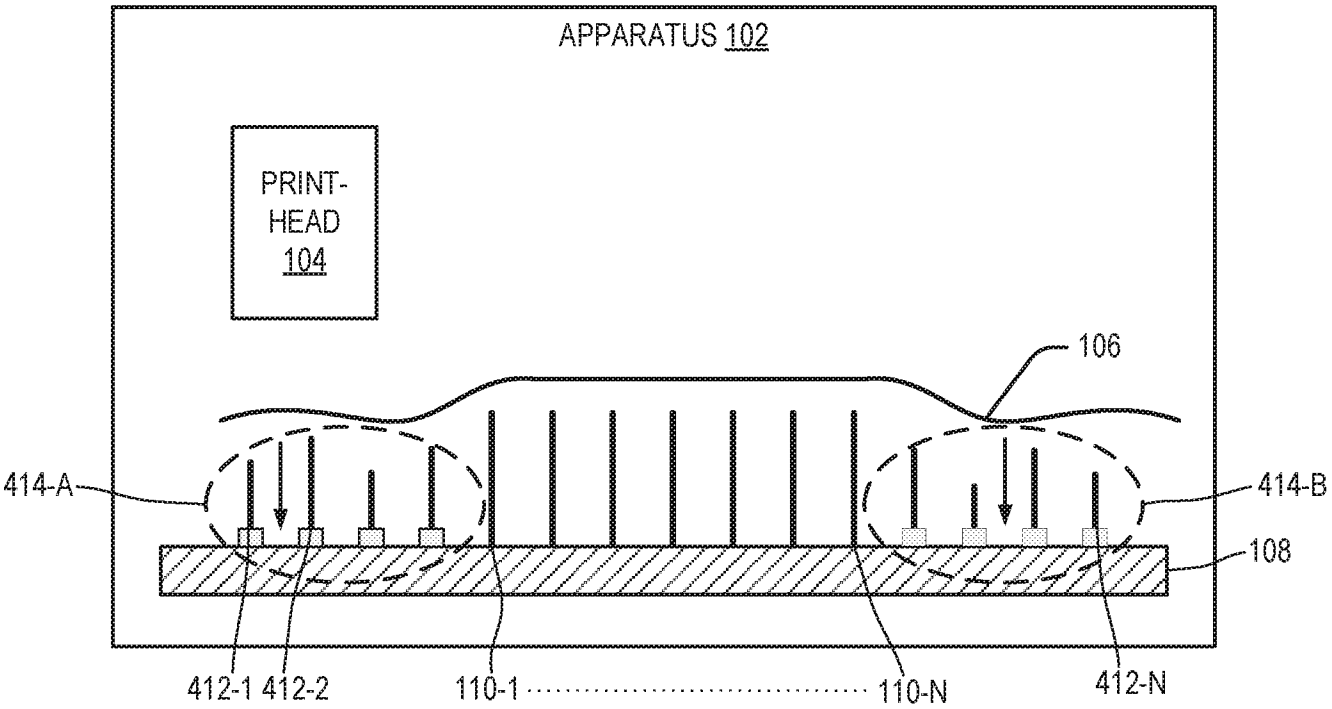
FIG. 4 depicts a front view of an example platen with lowered set of platen ribs.

Once the control engine(s) 212 determines the likelihood that any physical changes to the print media 106 are likely to occur, it may further control the platen ribs 112 and move them to a position between a raised and lowered position. For example, the control engine(s) 212 may determine, based on the parameter values 216, that the ink density is high for the print job under consideration. Accordingly, the control engine(s) 212 may conclude that the print media 106 is likely to curl during the printing operation. The manner in which the platen ribs 112 are operated is further explained in conjunction with FIGS. 3-4. FIGS. 3-4 depicts different instances in which the platen ribs 112 are fully raised (depicted as platen ribs 312) and when lowered (depicted as platen ribs 412).

Returning to the present example, the control engine(s) 212 on determining that the print media 106 is not likely to undergo any physical changes (such as curling) may generate one or more control signals for the actuation mechanism 210. As mentioned before, the separation distance between the print head 104 and the print media 106 would not vary in case the print media 106 does not undergo any curling. In such a case, the control engine(s) 212 may control the platen ribs to be in a raised position (depicted as ribs 312-1, 2, . . . , N). The raised ribs 312 are such that their relative height with respect to the platen 108 remains similar to the height of the first set of platen ribs 110. The control engine(s) 212 may proceed and generate control instructions for raising the second set of platen ribs 112. The second set of platen ribs 112 continues to move in the direction as indicated such that they are fully raised (as raised ribs 312 depicted in FIG. 3).

It may also be the case that the control engine(s) 212 may determine that the print media 106 is likely to curl during the printing operation. For example, the parameter values 216 may indicate that the ink density for the print job under consideration is greater than a threshold value. For the high ink density, the control engine(s) 212 may conclude that the print media 106 is likely to curl up towards the print head 104. Accordingly, the control engine(s) 212 may generate control signals for lowering selected platen ribs 112 from its raised position (as depicted in FIG. 4). The platen ribs 112 may be lowered in direction as shown in FIG. 4 such that the relative height of the lowered ribs (i.e., ribs 412-1 and 2—collectively referred to as ribs 412) is less than the height of the first set of platen ribs 110. In one example, the height to which the ribs 412 is lowered may vary between each of the lowered ribs 412. For example, as is illustrated, the height of the rib 412-1 differs from the height of the rib 412-2 even though the both the ribs 412-1 and 2 were lowered. The height of further ribs 412 may also be different. In the present example, the lowering of the ribs 412 is to counter the curling of the print media 106. The placement of the ribs 412 enable to maintain an optimal separation distance between the print head 104 and print media 106. As described, the present subject matter provides a set of moveable platen ribs which may be raised or lowered depending on whether the print media 106 is likely to curl or not. Preempting such a condition and accordingly raising and lowering the second set of platen ribs 112 improves print quality.

In the example as depicted in FIG. 4, the ribs 412 may be further grouped in two or more segments. For example, the segments 414-A, B may be so positioned such that they are present on either side of the first set of platen ribs 110. In one example, each of the ribs 412 (present in both segments 414-A, B) may be moveable together. In another example, motion of the segment 414-A may be independent from the motion of segment 414-B. In such a case, the actuation mechanism for the segment 414-A may be different from the actuation mechanism for the segment 414-B, without deviating from the scope of the present subject matter.

Figure 5:
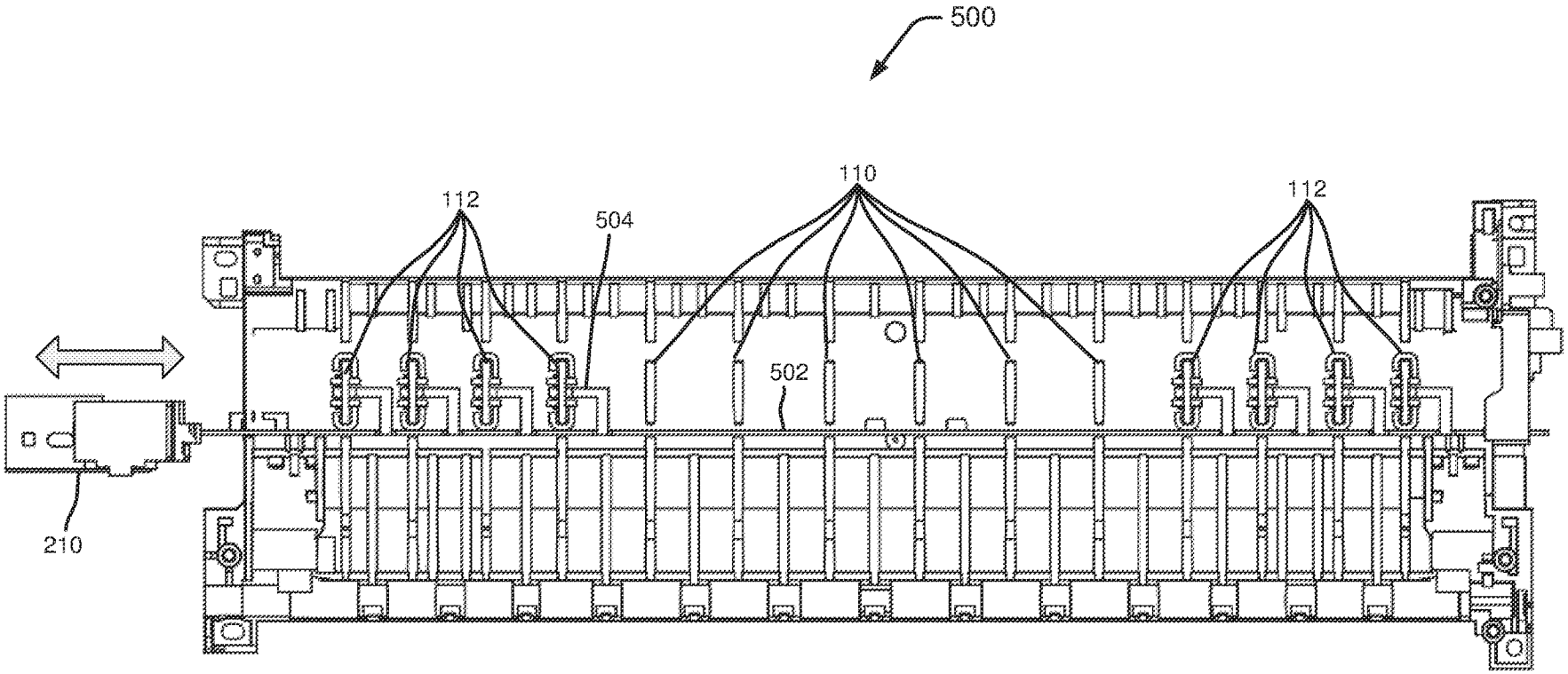
FIG. 5 depicts a top view of another example platen with set of movable platen ribs.

FIG. 5 is a top view of an example platen having rigid and moveable platen ribs. The platen 500 includes a first set of platen ribs 110 and a second set of platen ribs 112. The first set of platen ribs 110 is rigidly attached to the platen 500. The second set of platen ribs 112 on the other hand are moveable and may be lowered or raised orthogonally with respect to the platen 500. Each of the second set of platen ribs 112 is coupled to a shaft 502 through a connecting link 504. The connecting link 504 may be further coupled to a cam arrangement (not shown in FIG. 5) for each of the second set of platen ribs 112. The cam arrangement enables reciprocal motion of each of the second set of platen ribs 112.

The other end of the shaft 502 is in turn connected to an actuation mechanism 210. The actuation mechanism 210 actuates the second set of platen ribs 112 through the shaft 502. The actuation mechanism 210 may move in a direction as is depicted in FIG. 5. The actuating mechanism may provide an actuation motion which is transferred through the shaft 502 to each of the second set of platen ribs 112. The cam arrangement then enable the lowering or raising of one or more of the second set of platen ribs 112 accordingly. The present example only indicates a manner for actuating the second set of platen ribs 112. Other mechanisms for actuating the second set of platen ribs 112 are also possible and would also be within the scope of the claimed subject matter. In the present example, each of the second set of platen ribs 112 may be moveable together owing to the reciprocating actions of the actuation mechanism 210 which is transferred through the shaft 502. In another example, each of the second set of platen ribs 112 may be so configured such that each of the individual platen ribs 112 move independently of the other ribs 112. In such instances, each of the second set fo platen ribs 112 may be connected to their respective shafts and connecting links, without deviating from the scope of the present subject matter.

In another example, the platen 108 may be further provided with one or more ramp profiles coupled with each of the second set of platen ribs 112. The ramp profiles (not shown in FIG. 5) may be utilized for defining the extent to which any one of the second set of platen ribs may be raised. The ramp profiles may be utilized for defining one or more presets as per which the corresponding platen ribs 112 is raised but at different heights. The present example is only one of the other possible example which may be implemented. Other examples also lie within the scope of the present subject matter.

In yet another example, each of the second set of platen ribs 112 may be of different dimensions as an alternative to implementing ramp profiles for raising each of the second set of platen ribs 112 to different extents. Since to the variation in dimensions of each of the second set of platen ribs 112, the height of second set of platen ribs 112 when lowered would be varying between the different second set of platen ribs 112.

Figure 6:
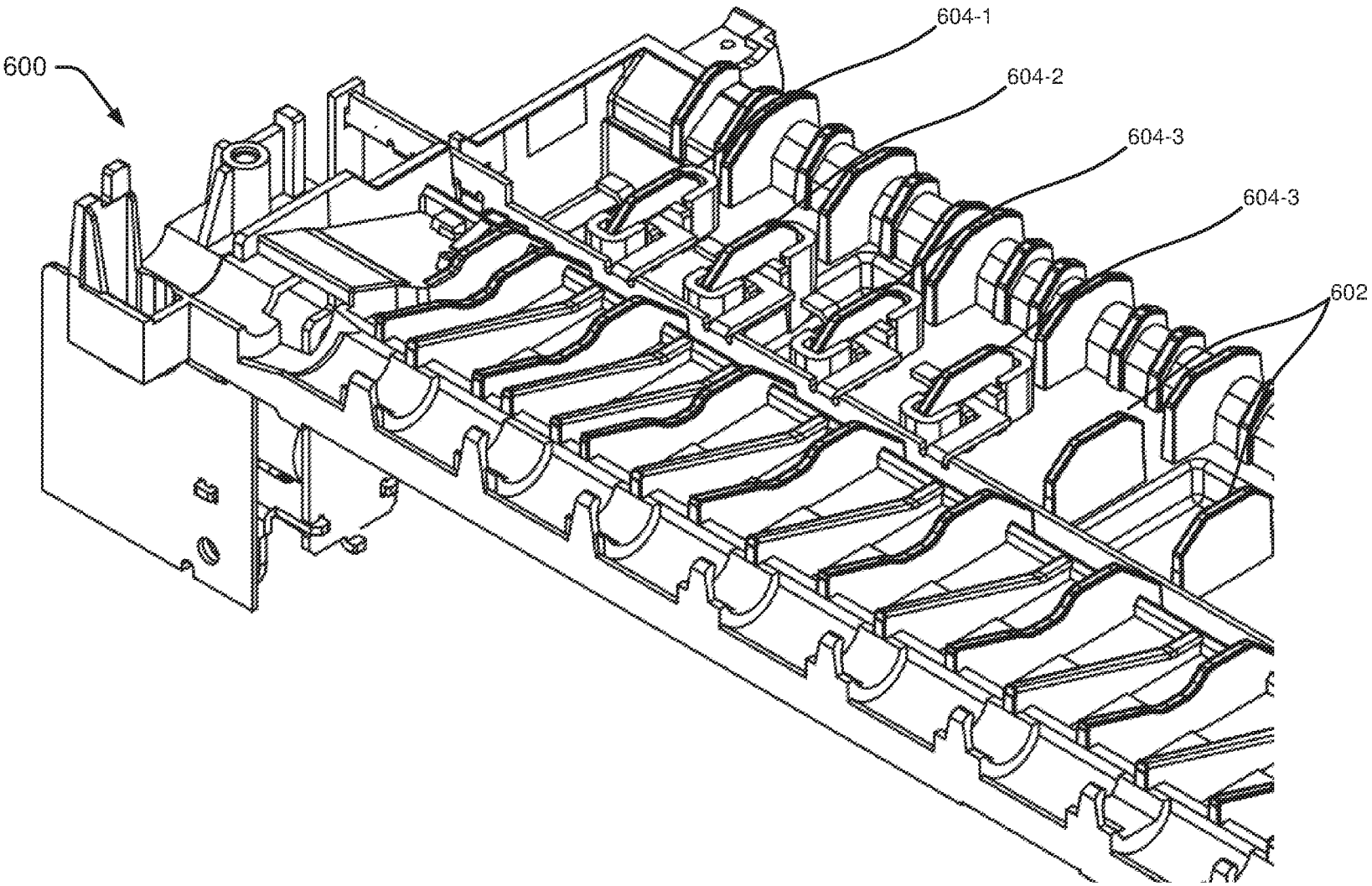
FIGS. 6-7 depicts a perspective view of an example platen.
Figure 7:
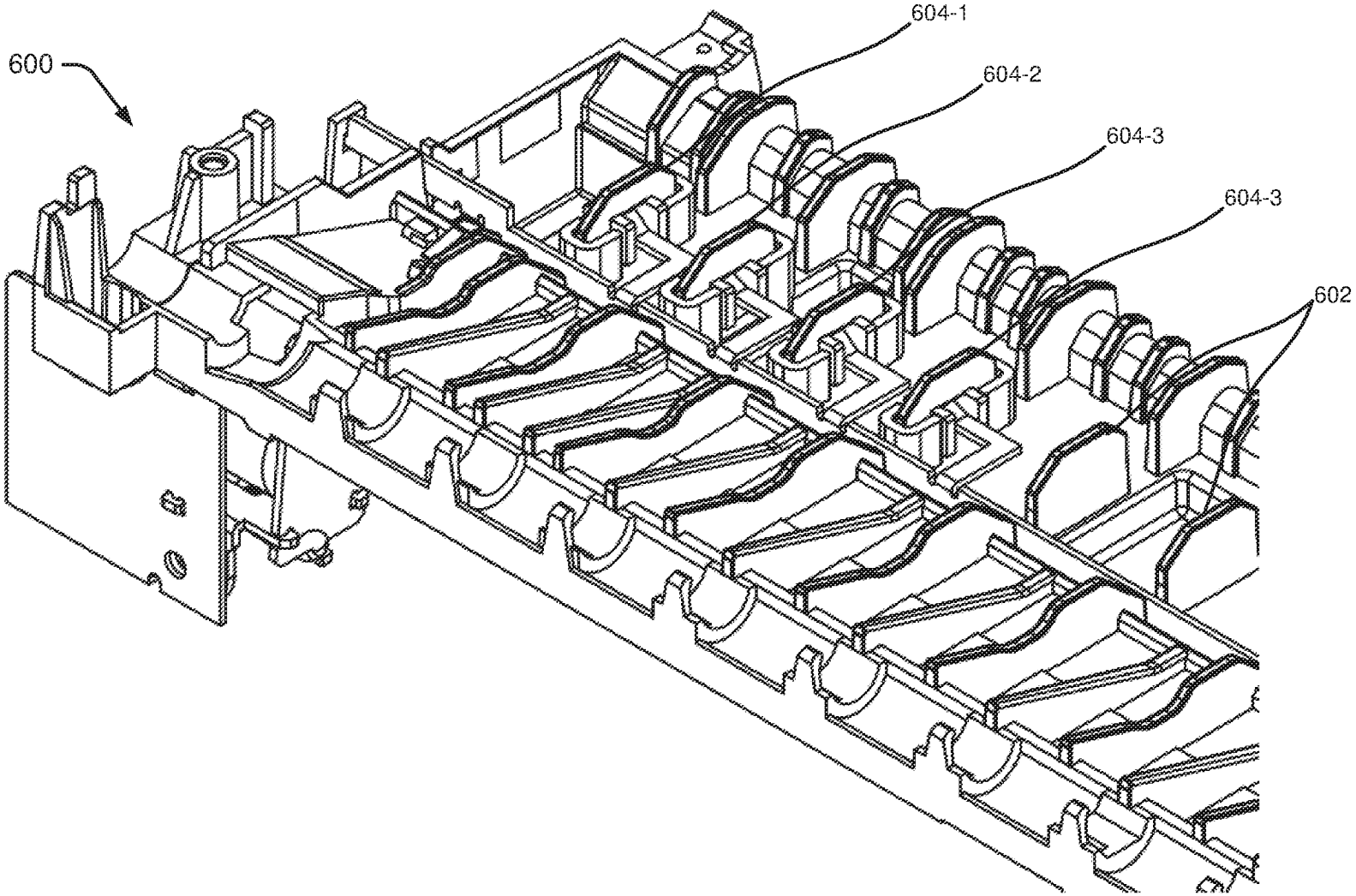

FIGS. 6 and 7 depict perspective view of a platen 600 as per another example of the present subject matter. The platen 600 (as depicted in FIGS. 6 and 7) illustrate various instances in which one or more moveable platen ribs may be in a raised or lowered position. As depicted in FIGS. 6-7, the platen 600 includes a plurality of rigidly mounted platen ribs 602 and a plurality of moveable platen ribs 604. The moveable platen ribs 604 may move in a direction perpendicular to the plane in which the platen 600 is present. As shown in FIG. 6., the moveable platen ribs 604-1 and 3 are in a lowered position. As explained previously, the moveable platen ribs 604 may be lowered in cases where it is determined that the print media 106 (not shown in FIGS. 6-7) may undergo physical changes, such as curling or cockling. If it is determined that the print media 106 is not likely to undergo any physical changes, then each of the moveable platen ribs 604 may be raised (as illustrated in FIG. 7). When in a raised position, the relative height of the moveable platen ribs 604 is comparable to the height of the first set of platen ribs 110.

Figure 8:
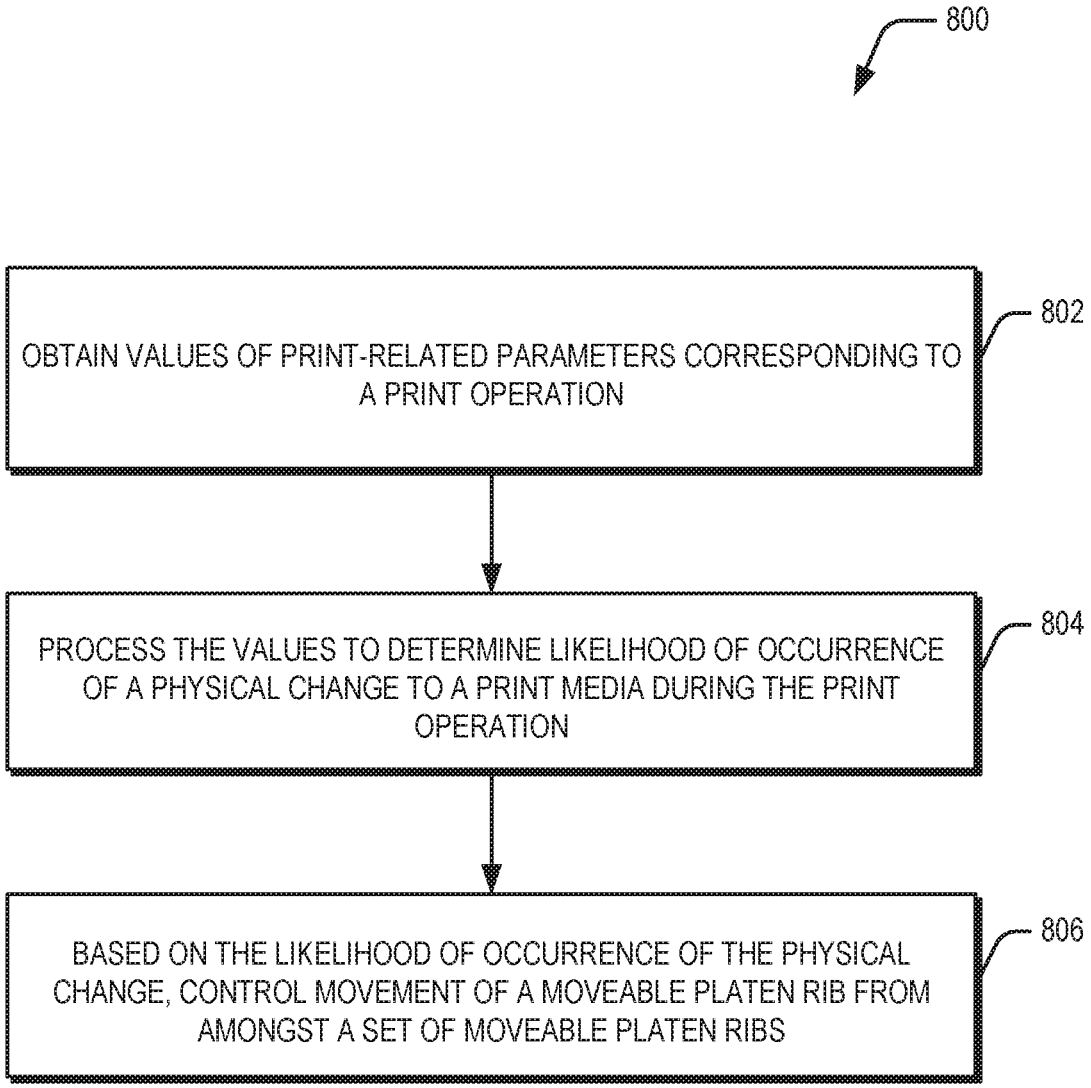
FIG. 8 depicts an example method for controlling spacing between print media and print head of a print apparatus.

FIG. 8 illustrates example method 800, implemented in an apparatus having moveable platen ribs. The moveable platen ribs are used for controlling separation distance between print media and print head, as per an example of the present subject matter. The order in which the method steps are described is not intended to be construed as a limitation, and any number of the described method blocks may be combined in any order to implement the aforementioned method, or an alternative method. Furthermore, method 800 may be implemented by processing resource or computing device(s) through any suitable hardware, non-transitory machine readable instructions, or combination thereof.

At block 802, values of print-related parameters are obtained. In one example, the control engine(s) 212 may process a print request to obtain values of print-related parameters. The values are stored in parameter values 216. As discussed in previous paragraphs, print-related parameters may be considered as defining one or more parameters based on which a print device, such as the apparatus 102, processes instructions and prints content on a print media 106. The parameter values 216 may provide one or more values depicting such different conditions which may be present, or may have to be considered while processing a print job.

At block 804, the values of the print-related parameters are processed to determined likelihood of physical change of a print media. For example, the control engine(s) 212 may compare the parameter values 216 with mapping data 218. In the present example, the mapping data 218 may provide a mapping between one or more parameter values 216 with indications suggesting that the print media 106 is likely to undergo a change.

At block 806, based on the values of the print-related parameters one or more moveable platen ribs may be actuated to move between a raised and a lowered position. For example, based on the parameter values 216, the control engine(s) 212 may determine whether a second set of platen ribs 112 coupled are to be moved. To this end, the control engine(s) 212 may estimate whether the print media 106 is likely to undergo any physical changes during the printing operation based on the print-related parameters stored as parameter values 216. In case if it is determined that the print media 106 is to undergo a physical change, such as curling, the control engine(s) 212 may further generate one or more control instructions for lowering the second set of moveable platen ribs 112. Conversely if it is determined that the print media 106 will not undergo any physical change, the control engine(s) 212 may generate control signals to raise the second set of platen ribs 112.

Figure 9:
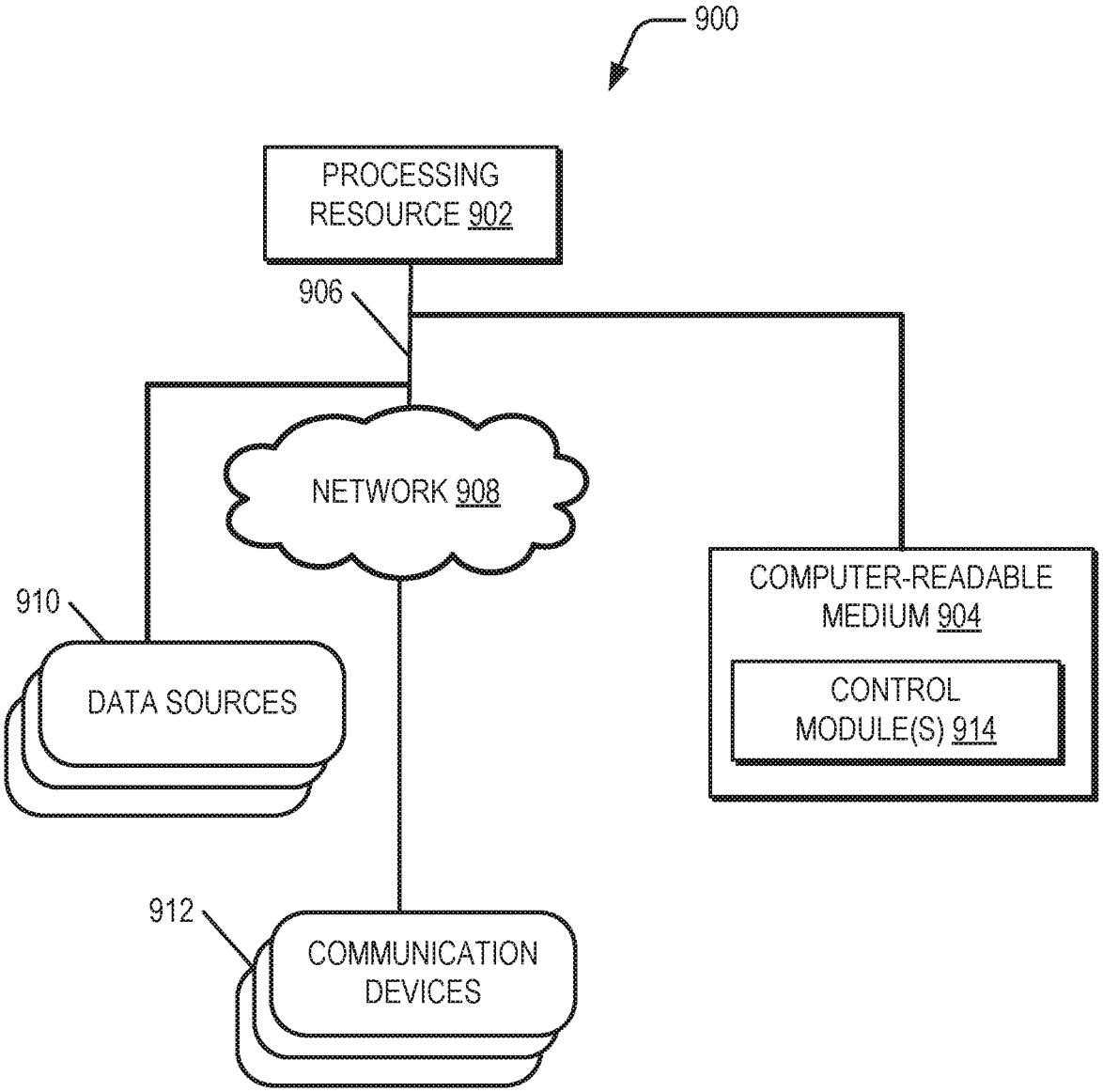
FIG. 9 is a block diagram of an example environment implementing a non-transitory computer-readable medium, for controlling spacing between print media and print head.

FIG. 9 illustrates an environment 900 for controlling separation distance between print media and print head of a print apparatus having a plurality of moveable platen ribs, according to an example of the present disclosure. The environment 900 may comprise at least a portion of a public networking environment or a private networking environment, or a combination thereof. In one implementation, the environment 900 includes a processing resource 902 communicatively coupled to a computer readable medium 904 through a communication link 906.

In one example, the processing resource 902 may include one or more processors of a computing device for generating instructions for moving second set of platen ribs for controlling spacing between print media and print head. In another example, multiple processors may also be used for implementing the processing resource 902. The computer readable medium 904 may be, for example, an internal memory device of the computing device or an external memory device. In one implementation, the communication link 906 may be a direct communication link, such as any memory read/write interface. In another implementation, the communication link 906 may be an indirect communication link, such as a network interface. In such a case, the processing resource 902 can access the computer readable medium 904 through a network 908. The network 908 may be a single network or a combination of multiple networks and may use a variety of different communication protocols.

The processing resource 902 and the computer readable medium 904 may also be coupled to data sources 910 through the communication link 906, and/or to communication devices 912 over the network 908. The coupling with the data sources 910 enables in receiving the data in an offline environment, and the coupling with the communication devices 912 enables in receiving the data in an online environment.

In one implementation, the computer readable medium 904 includes a set of computer readable instructions, implementing a control module(s) 914. The instructions implementing control module(s) 914 may, in one example, be executable code for moving the second set of platen ribs 112. The set of computer readable instructions within medium 904 may be accessed by the processing resource 902 through the communication link 906 and subsequently executed to process data communicated with the data sources 910 in order to control spacing between print media and print head of a print apparatus. To this end, the control module(s) 914 controls one or more moveable platen ribs of an apparatus, such as the apparatus 102.

The apparatus 102 includes a first set of platen ribs 110 and a second set of platen ribs 112, each of which are mounted onto a platen 108 (depicted in FIG. 1). The second set of platen ribs 112 are moveable with respect to the platen 108. The second set of platen ribs 112 may move between a completely raised position and a lowered position. As each of the second set of platen ribs 112 move, their relative height with respect to the first set of platen ribs 110 varies. In operation, the control module(s) 914 may determine values of one or more print-related parameters. In one example, the values of the print-related parameters may be obtained based on a print request from a user. The values may then be stored in parameter values 216.

Based on the parameter values 216, the control module(s) 914 may determine whether the print media 106 is likely to under any physical changes during a printing operation. For example, the control module(s) 914 may, based on ink density, determine that the print media 106 will most likely curl during the printing operation. The control module(s) 914 may compare the parameter values 216 with mapping data 218 which correlates one or more parameter values 216 with likely physical changes that may occur.

On determining whether the print media 106 will undergo any physical changes, the control module(s) 914 may generate one or more control instructions for affecting movement of the second set of platen ribs 112. In the present example, such control instructions which when executed may activate an actuation mechanism, for example actuation mechanism 210, for controlling the second set of platen ribs 112. If it is determined that the print media 106 is likely to undergo any physical change, for example curling, the control instructions when executed will raise the second set of platen ribs 112. When in a raised position, the relative height of the second set of platen ribs 112 is lower as compared to the height of the first set of platen ribs 110. On the other hand, if it is determined that the print media 106 is not likely to undergo any physical changes, then the control instructions would be such, that when executed raise the level of the second set of platen ribs 112.

Although examples for the present disclosure have been described in language specific to structural features and/or methods, it should be understood that the appended claims are not necessarily limited to the specific features or methods described. Rather, the specific features and methods are disclosed and explained as examples of the present disclosure.

We claim:

1. An apparatus comprising:

a platen to support a print media, wherein the platen extends in a plane in which the print media is conveyed for printing; and a first set of platen ribs and a second set of platen ribs each mounted to extend approximately perpendicular from a surface of the platen to contact and support the print media, wherein each platen rib of the first set of platen ribs extends a first extent from the surface of the platen, and each platen rib of the second set of platen ribs is independently moveable with respect to other platen ribs of the second set of platen ribs approximately perpendicular to the surface of the platen and the plane to extend different extents from the surface of the platen less than and up to the first extent of the first set of platen ribs.

2. The apparatus as claimed in claimed in claim 1, comprising a print head and a control engine in communication with the second set of platen ribs extended approximately perpendicular from the surface of the platen, wherein the control engine is to:

obtain values of print-related parameters corresponding to a printing operation;

based on the values of the print-related parameters, estimating occurrence of physical changes in the print media during the printing operation; and based on estimating, generating control signals for actuating any one of the second set of platen ribs to move approximately perpendicular to the surface of the platen and the plane and control spacing between the print media and the print head.

3. The apparatus as claimed in claim 1, wherein the second set of platen ribs are to contact and support portions of the print media in proximity to edges of the print media.

4. The apparatus as claimed in claim 2, wherein the print-related parameters comprise attributes pertaining to one of a print job corresponding to the printing operation and physical properties of the print media.

5. The apparatus as claimed in claim 4, wherein the attributes pertaining to the print job comprises ink density with which content is to be printed on the print media.

6. The apparatus as claimed in claim 2, comprising an actuation mechanism coupled to the control engine, wherein the actuation mechanism is to:

receive the control instructions generated by the control engine; and based on the control instructions, actuate one of the second set of platen ribs extended approximately perpendicular from the surface of the platen to move approximately perpendicular to the surface of the platen and the plane.

7. The apparatus as claimed in claim 6, wherein the actuation mechanism comprises a cam-linkage mechanism.

8. The apparatus as claimed in claim 1, wherein the first set of platen ribs and second set of platen ribs are arranged serially, with the first set of platen ribs arranged in middle of the second set of platen ribs.

9. The apparatus as claimed in claim 2, wherein for estimating the occurrence of the physical changes the control engine is to further:

compare the values with mapping data, wherein the mapping data correlates the values with indications suggesting that the print media is likely to undergo the physical change; and estimating occurrence of the physical change if the value matches the mapping data.

10. The apparatus as claimed in claim 1, wherein the each of the second set of platen ribs extended approximately perpendicular from the surface of the platen is of a different dimension.

11. A method comprising:

obtaining values of print-related parameters corresponding to a printing operation;

processing the values to determine likelihood of occurrence of a physical change to a print media during the printing operation, the print media supported by a platen extended in a plane in which the print media is conveyed during the printing operation; and based on the likelihood of occurrence of the physical change, controlling movement of a moveable platen rib from amongst a set of moveable platen ribs, the set of moveable platen ribs and another set of platen ribs each extending approximately perpendicular from a surface of the platen to contact and support the print media, and each moveable platen rib of the set of moveable platen ribs being independently moveable with respect to other moveable platen ribs of the set of moveable platen ribs approximately perpendicular to the surface of the platen and the plane to extend different extents from the surface of the platen less than and up to an extent to which each platen rib of the another set of platen ribs extends from the surface of the platen.

12. The method as claimed in claim 11, wherein the print-related parameters comprise attributes pertaining to one of print job corresponding to the printing operation and physical properties of the print media.

13. The method as claimed in claim 12, wherein the attributes comprise physical properties of the print media.

14. The method as claimed in claim 11, wherein the controlling comprises one of:

lowering the set of moveable platen ribs on determining that the print media is likely to undergo the physical change; and raising the set of moveable platen ribs on determining that the print media is not likely to undergo the physical change.

15. A non-transitory computer-readable medium comprising instructions executable by a processing resource to:

obtain values of print-related parameters corresponding to a printing operation;

process the values to determine likelihood of occurrence of a physical change to a print media during the printing operation; and generate control signals based on the likelihood of occurrence of the physical change, to affect control of moveable platen ribs to move between a raised position and a lowered position, wherein the print media is supported by a platen extended in a plane in which the print media is conveyed during the printing operation, and wherein the set of moveable platen ribs and another set of platen ribs each extend approximately perpendicular from a surface of the platen to contact and support the print media, and each moveable platen rib of the set of moveable platen ribs is independently moveable with respect to other moveable platen ribs of the set of moveable platen ribs approximately perpendicular to the surface of the platen and the plane to extend different extents from the surface of the platen less than and up to an extent to which each platen rib of the another set of platen ribs extends from the surface of the platen.

* * * * *